US011112197B2

(12) United States Patent
Underwood et al.

(10) Patent No.: US 11,112,197 B2
(45) Date of Patent: Sep. 7, 2021

(54) PIVOT PIN

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 17/117,205

(22) Filed: Dec. 10, 2020

(65) Prior Publication Data

US 2021/0180897 A1 Jun. 17, 2021

Related U.S. Application Data

(60) Provisional application No. 62/947,171, filed on Dec. 12, 2019.

(51) Int. Cl.
*F41A 11/00* (2006.01)
*F41A 3/66* (2006.01)

(52) U.S. Cl.
CPC ..... *F41A 11/00* (2013.01); *F41A 3/66* (2013.01)

(58) Field of Classification Search
CPC ..... F41A 11/00; F41A 11/04; F41A 11/02; F41A 3/64; F41A 3/66
See application file for complete search history.

(56) References Cited

U.S. PATENT DOCUMENTS 7,937,876 B1 * 5/2011 Graham ..... F41A 11/00 42/75.03
9,151,555 B1 * 10/2015 Huang ..... F16B 15/02
9,243,857 B2 * 1/2016 Mills ..... F41A 35/00
9,389,031 B2 * 7/2016 Gardner ..... F41A 3/66
9,400,006 B1 * 7/2016 Huang ..... F16B 21/125
D762,804 S * 8/2016 Gardner ..... D22/108
9,909,828 B1 * 3/2018 Klein ..... F41A 3/66
10,101,107 B1 * 10/2018 Huang ..... F41A 3/66
10,126,078 B1 * 11/2018 Harris ..... F16B 21/12
10,267,584 B2 * 4/2019 Kasanjian-King ..... F41A 11/00
D865,105 S * 10/2019 Oglesby ..... D22/108
10,578,380 B2 * 3/2020 Jen ..... F41A 3/66
10,663,239 B2 * 5/2020 Timmons ..... F41A 11/02
D886,934 S * 6/2020 Geissele ..... D22/108
10,746,486 B2 * 8/2020 Jen ..... F41A 3/66
D898,858 S * 10/2020 Geissele ..... D22/108
10,866,042 B1 * 12/2020 Huang ..... F41A 11/00
2013/0055610 A1 * 3/2013 Watkins ..... F41A 11/04 42/16
2013/0205637 A1 * 8/2013 Patel ..... F41A 11/02 42/75.02
2014/0317982 A1 * 10/2014 Gentilini ..... F41A 3/12 42/16
2015/0308768 A1 * 10/2015 Mills ..... F41A 35/00 42/75.03
2017/0016690 A1 * 1/2017 Timmons ..... F41A 11/00
2017/0051546 A1 * 2/2017 Seekins ..... F41A 35/00
2017/0299292 A1 * 10/2017 Daley, Jr. ..... F41A 3/66
2018/0187989 A1 * 7/2018 Jen ..... F41A 3/66
2019/0072123 A1 * 3/2019 Adams ..... F41A 11/00

* cited by examiner

*Primary Examiner* — Joshua E Freeman

(57) ABSTRACT

A pivot pin for a firearm includes a proximal end, a distal end, a cylindrical surface extending between the proximal end and the distal end, a head disposed at the distal end where the head includes a flat portion, a groove extending along at least a portion of a length of the cylindrical surface, and a hole extending through the pivot pin. The hole is located between the groove and the proximal end.

17 Claims, 5 Drawing Sheets

PIVOT PIN

CROSS REFERENCE TO RELATED APPLICATION

This application is related to and claims priority benefit from U.S. Provisional Application No. 62/947,171 ("the '171 application"), filed on Dec. 12, 2019 and entitled "PIVOT PIN." The '171 application is hereby incorporated in its entirety by this reference.

FIELD OF THE INVENTION

The field of the invention relates to firearms, particularly pivot pins and methods for installing pivot pins in firearms.

BACKGROUND

Many modern firearms are designed with pinned connections for attaching components or subassemblies to one another. Such pinned connections allow for modularity and for quick disassembly for service, cleaning, or other operations. Many firearms include multiple receivers including, for example, a lower receiver and an upper receiver. As one example, the AR-15 variant (civilian) or M16/M4 (military) firearm platform includes a lower receiver and an upper receiver. Conventional pins for securing attachment between firearm components or subassemblies follow traditional designs and are difficult to assemble often resulting in misplaced components. Many consumers or manufacturers assemble the various components for a complete lower receiver. For example, a consumer may purchase a "stripped" lower receiver and install a lower parts kit, which includes, among other components, a pivot pin and the related components. It is common for a consumer or manufacturer to have difficulty retaining the detent and spring within the receiver while installing the pivot pin. Although there is a separate specialized tool available for installing conventional pivot pins, these tools are often not available or misplaced.

To simplify and streamline assembly while maximizing efficiency and minimizing frustration, it may be desirable to design new pivot pins that facilitate installation using common tools and without a separate specialized tool.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a pivot pin for a firearm comprises: a proximal end; a distal end; a cylindrical surface extending between the proximal end and the distal end; a head disposed at the distal end, the head comprising a flat portion; a groove extending along at least a portion of a length of the cylindrical surface; and a hole extending through the pivot pin, wherein the hole is located between the groove and the proximal end.

According to certain embodiments of the present invention, a pivot pin assembly for installation into a receiver of a firearm comprises: a pivot pin; a detent; and a detent spring, wherein the pivot pin comprises: a proximal end; a distal end; a cylindrical surface extending between the proximal end and the distal end; a groove extending along at least a portion of a length of the cylindrical surface; and a hole extending through the pivot pin, wherein the hole is located between the groove and the proximal end.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1A-5 illustrate components of various semi-automatic or automatic firearms, the features, concepts, and functions described herein are also applicable (with potential necessary alterations for particular applications) to handguns, rifles, carbines, shotguns, or any other type of firearm. Furthermore, the embodiments may be compatible with various calibers including rifle calibers such as, for example, 5.56×45 mm NATO, 0.223 Remington, 7.62×51 mm NATO, 0.308 Winchester, 7.62×39 mm, 5.45×39 mm; pistol calibers such as, for example, 9×19 mm, 0.45 ACP, 0.40 S&W, 0.380 ACP; and shotgun calibers such as, for example, 12 gauge, 20 gauge, 28 gauge, 0.410 gauge, 10 gauge, 16 gauge. The illustrated embodiments focus on a pivot pins for attaching upper and lower receivers for the AR-15 variant (civilian) or M16/M4 (military) firearm platform; however, the concepts and features described herein can be are also applicable (with potential necessary alterations for particular applications) to other components of the AR-15/M16/M4 platform and to components of other firearms.

Figure 2:
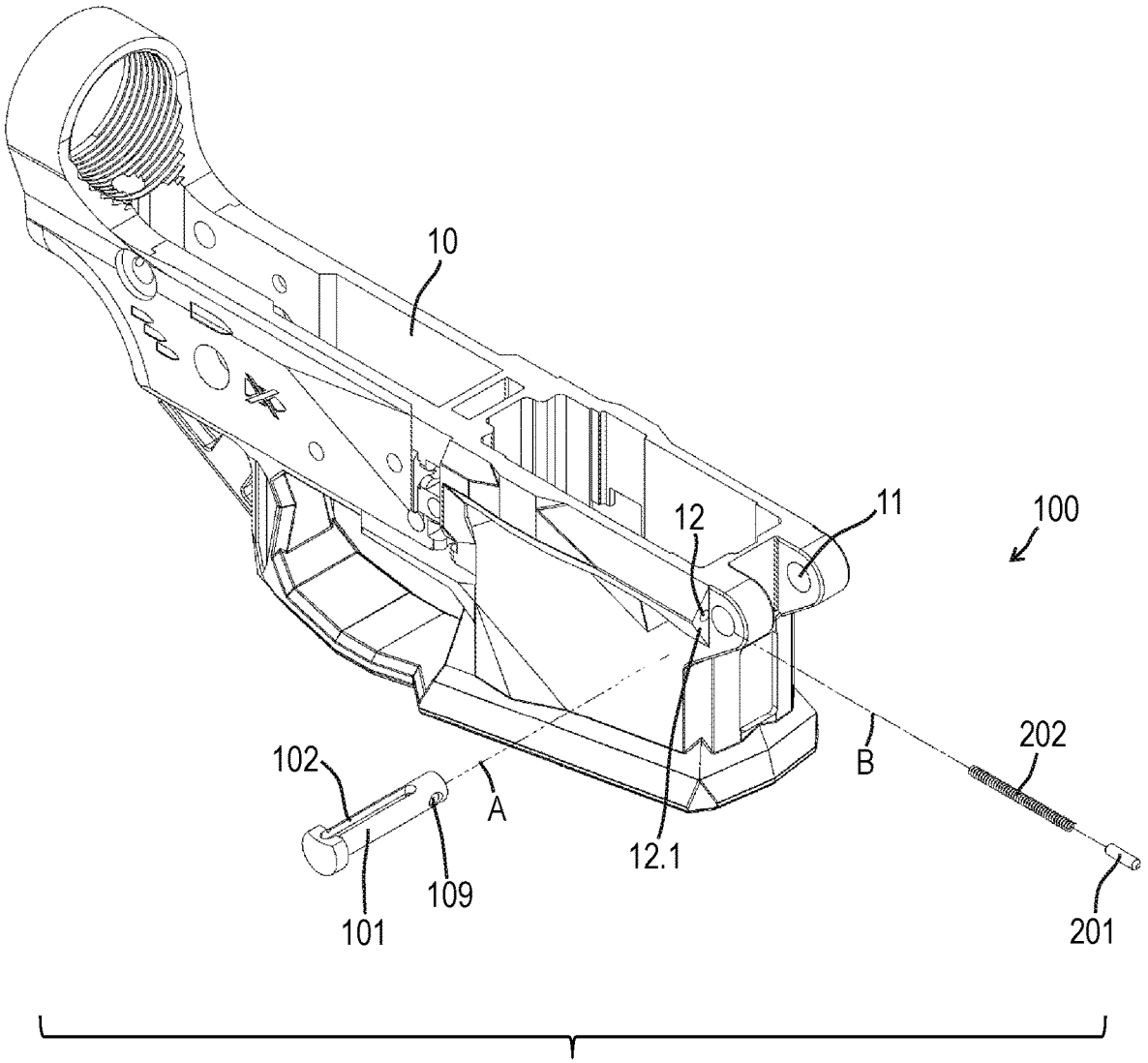
FIG. 2 is an exploded perspective view of a pivot pin installation assembly for the pivot pin of FIG. 1A.

In some cases, a pivot pin assembly 100 includes a pivot pin 101, a detent 201, and a detent spring 202 where the pivot pin assembly 100 can be installed in a receiver of a firearm including, for example, a lower receiver 10 (see FIG. 2). In an installed configuration, the pivot pin 101 is disposed within front pin hole 11 while the detent 201 and the detent spring 202 are disposed within detent hole 12 of the receiver 10 (see FIGS. 2-5). As shown in FIG. 2, a forward end of the detent hole 12 is located on a surface 12.1 (that may be approximately flat/planar) of the lower receiver 10. In some embodiments, the surface 12.1 faces a forward direction of the lower receiver 10.

Figure 1A:
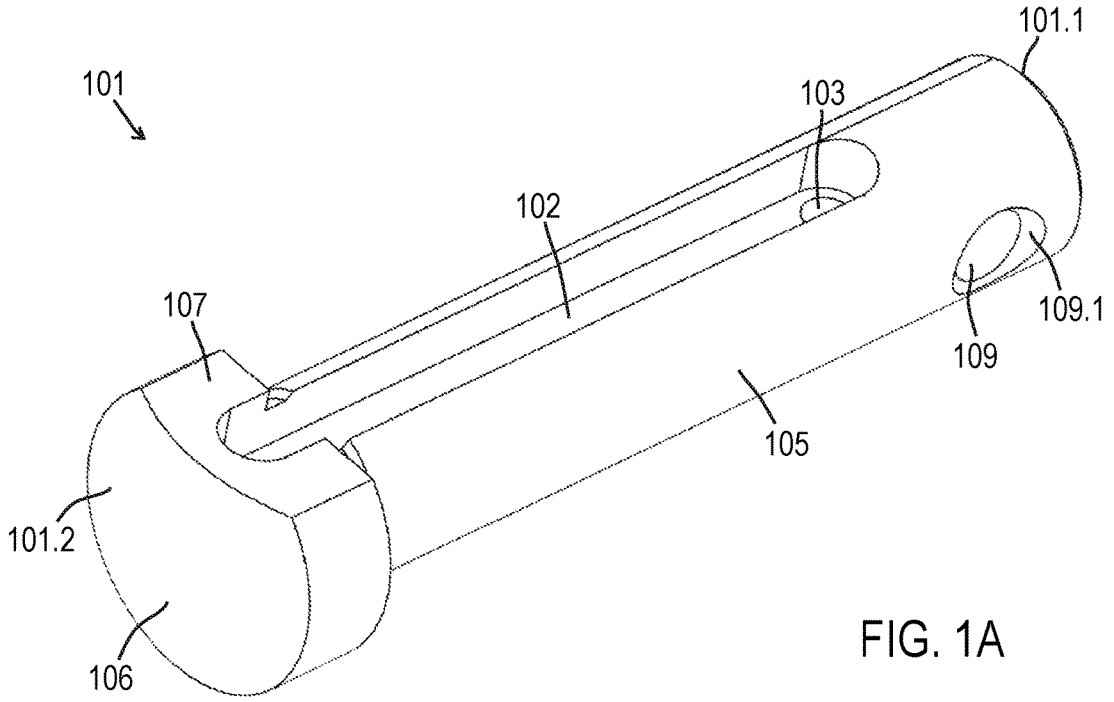
FIGS. 1A and 1B are perspective views of a pivot pin according to certain embodiments of the present invention.
Figure 1B:
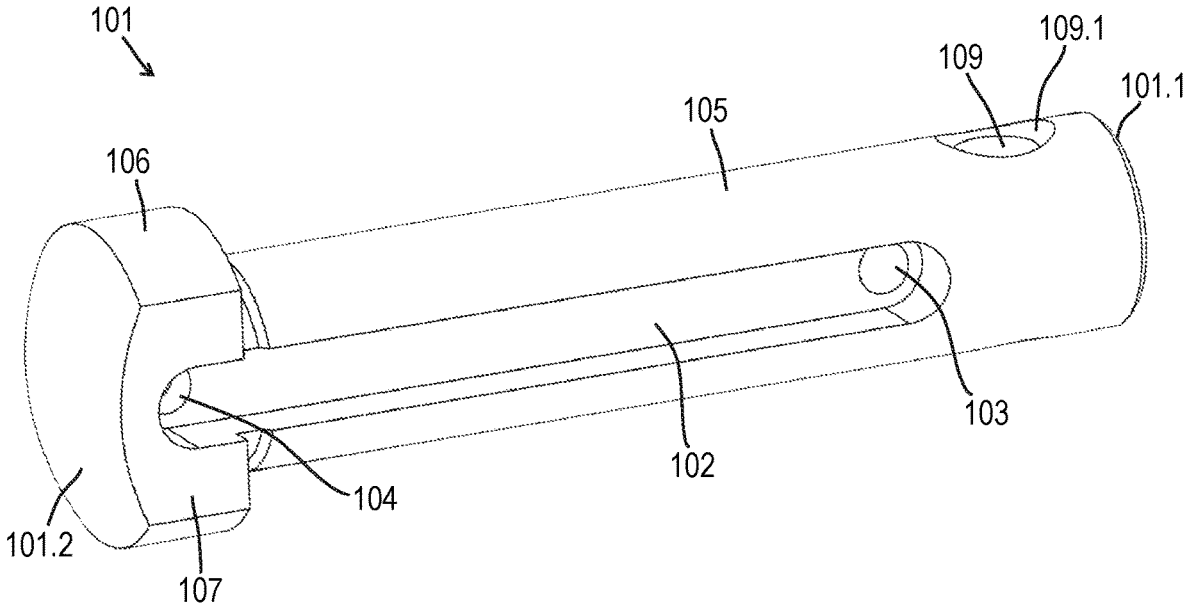
Figure 4:
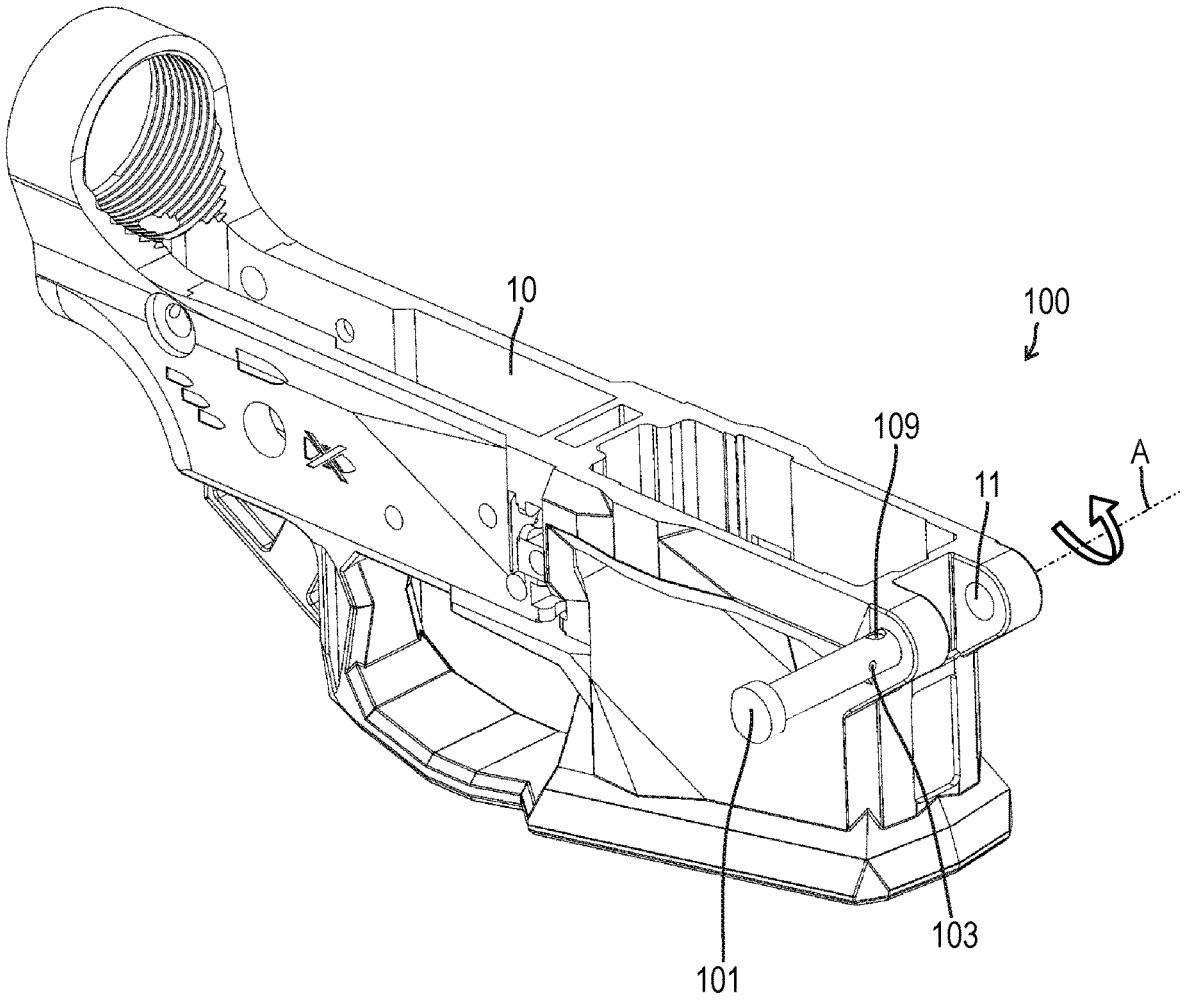
FIG. 4 is a perspective view of the pivot pin installation assembly of FIG. 2.
Figure 5:
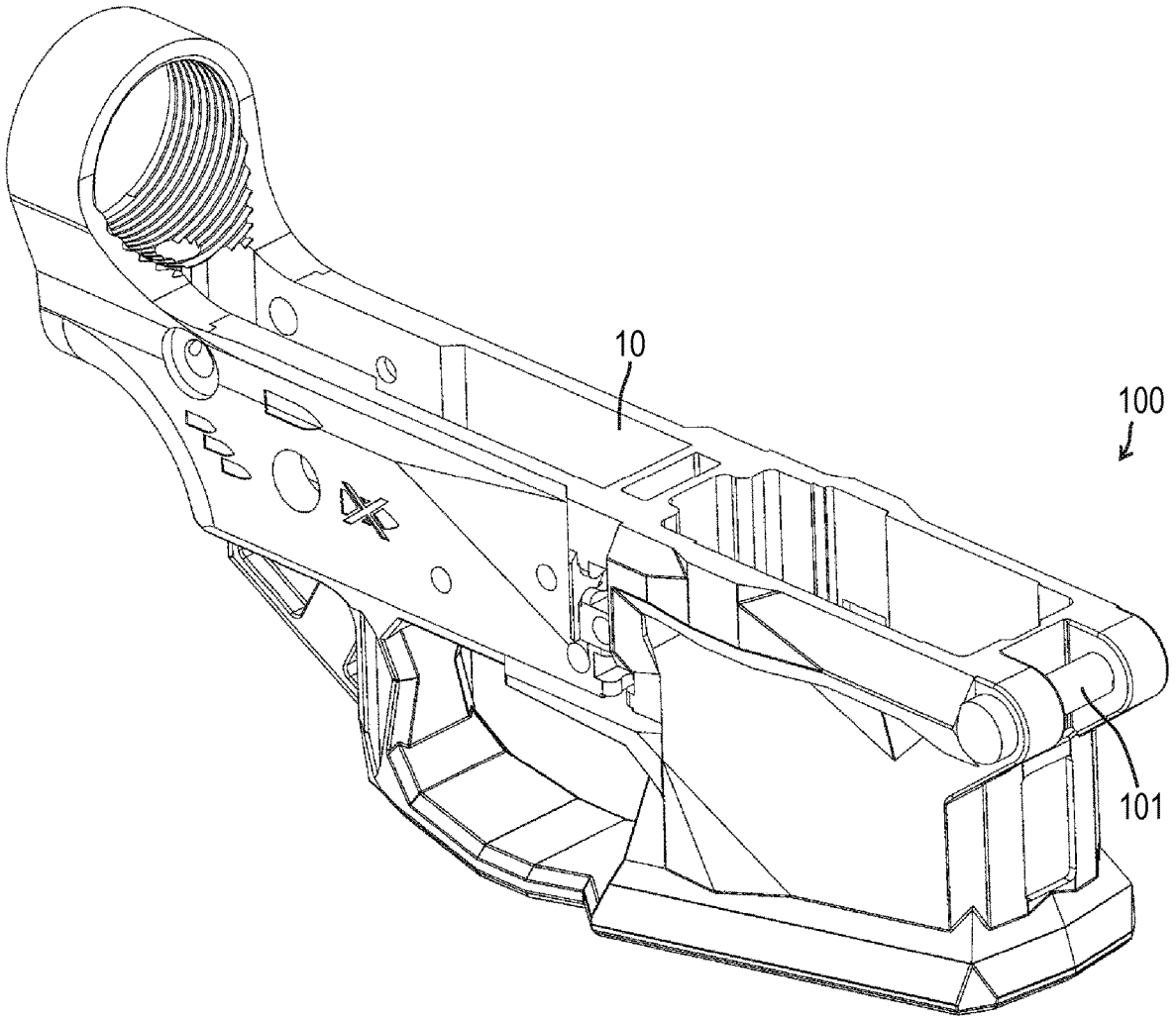
FIG. 5 is a perspective view of the pivot pin installation assembly of FIG. 2.

As shown in FIGS. 1A and 1B, the pivot pin 101 includes a proximal end 101.1, a distal end 101.2, a cylindrical surface 105 and a head 106 (at the distal end 101.2) where the head 106 has a flat portion 107. The pivot pin 101 may also include a groove 102 on the cylindrical surface 105 where the groove 102 includes a first recess 103 and a second recess 104. The groove 102 may be aligned with the flat portion 107 of the head 106. Unlike conventional pivot pins, pivot pin 101 includes an additional hole 109 where hole 109 passes through the entire section of the pivot pin 101. As shown in FIGS. 1A and 1B, the hole 109 may be located between the end of the groove 102 and the proximal end 101.1. In other words, the hole 109 and the groove 102 do not overlap. The hole 109 may be large enough for the detent 201 and the detent spring 202 to pass through. In some embodiments, the hole 109 is oriented approximately perpendicular (i.e., 90°) from the groove 102. In other words, an axial direction of hole 109 is approximately perpendicular to the location of the groove 102 on the cylindrical surface 105. In some embodiments, at least one of the first recess 103 and the second recess 104 includes a hole with at least a portion that passes through the entire pivot pin 101. In some embodiments, at least one of the first recess 103 and the second recess 104 includes a blind hole that does not pass through the pivot pin 101. As one example, FIG. 4 shows a pivot pin 101 where a portion of the first recess 103 passes through the entire pivot pin 101 and the second recess 104 includes a blind hole that does not pass through the pivot pin 101 (therefore the second recess 104 is not visible in this view). The portion of first recess 103 that reaches the opposite side of the pivot pin 101 from the groove 102 (i.e., the portion of recess 103 visible in FIG. 4) is smaller in diameter than the detent 201 and the detent spring 202 such that these components cannot pass through the recess 103 (unlike hole 109). For example, a tool (e.g., a small punch) can be inserted through the recess 103 to compress the detent spring 202.

For conventional pivot pins, the detent 201 and the detent spring 202 must be inserted into detent hole 12 of the receiver 10 and subsequently the conventional pivot pin is used hold the detent 201 and the detent spring 202 within hole 12 while simultaneously inserting the pivot pin into front pin hole 11.

Figure 3:
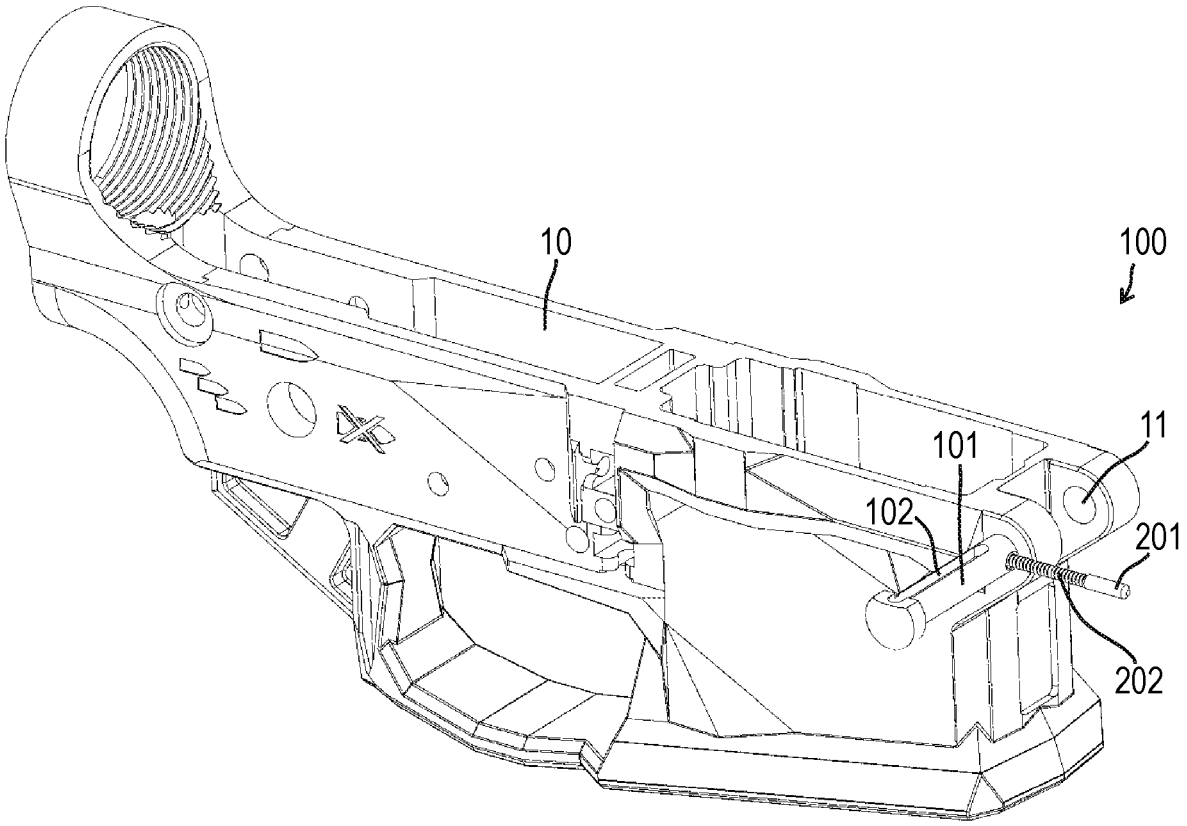
FIG. 3 is a perspective view of the pivot pin installation assembly of FIG. 2.

However, the design of pivot pin 101 allows the detent 201 and the detent spring 202 to be inserted into detent hole 12 of the receiver 10 (along axis B) after the pivot pin 101 is inserted into front pin hole 11 (along axis A). As shown in FIG. 3, the pivot pin 101 is partially inserted into front pin hole 11 such that hole 109 is approximately aligned with detent hole 12 of the receiver 10 (i.e., axis B shown in FIG. 2). The detent 201 and the detent spring 202 may then be inserted into detent hole 12 of the receiver 10 through hole 109 (see FIGS. 2-3). The detent spring 202 is inserted first, followed by the detent 201. In some embodiments, a tool, such as a 1/16" punch can be inserted into hole 109 to push the detent 201 and the detent spring 202 such that the detent 201 (and the detent spring 202) are entirely located within the detent hole 12 of the receiver 10. Other tools can be used to push the detent 201 and the detent spring 202 into detent hole 12 as long as the tool is small enough to fit within hole 109 (e.g., an Allen wrench). As shown in FIGS. 1A and 1B, one or both ends of the hole 109 may include a bevel 109.1. The bevel 109.1 may be helpful for inserting the detent 201 and the detent spring 202 into hole 109.

Once the detent 201 and the detent spring 202 are inserted into detent hole 12 of the receiver 10 (such that the detent spring 202 is being compressed), the tool is adjusted such that the end of the tool that interfaces with the detent 201 is located within detent hole 12 of the receiver 10. The next step is to slowly retract the tool from detent hole 12 while simultaneously attempting to rotate pivot pin 101. The presence of the tool within detent hole 12 will prevent pivot pin 101 from rotating. When the end of the tool reaches the opening of detent hole 12, the pivot pin 101 will rotate about axis A such that hole 109 is no longer aligned with detent hole 12. In some embodiments, when the pivot pin 101 is being rotated, the bevel 109.1 helps keep the detent 201 (and the detent spring 202) within detent hole 12. Rotation of the pivot pin 101 also causes the outer cylindrical surface 105 of the pivot pin 101 to hold the detent 201 and the detent spring 202 within detent hole 12 (see FIG. 4). After the pivot pin 101 is pushed further into front pin hole 11 and the pivot pin 101 is rotated approximately 90° from the orientation where the hole 109 is aligned with detent hole 12, the pivot pin 101 will be arranged such that the detent hole 12 is aligned with a portion of the groove 102 (and the flat portion 107 of the head 106 is approximately parallel with the surface 12.1 of the lower receiver 10).

Aligning the detent hole 12 with a portion of the groove 102 causes the detent 201 to engage groove 102. When the detent 201 engages the first recess 103 (i.e., when the detent spring 202 pushes the detent 201 into the first recess 103), the pivot pin 101 is in an open configuration where an additional component (such as an upper receiver, which is not shown) can be engaged with or disengaged from the lower receiver 10 (see FIG. 4). The pivot pin 101 can move along axis A to a closed configuration where the detent 201 engages the second recess 104 (see FIG. 5). The closed configuration is used to secure the additional component (such as an upper receiver, which is not shown) relative to the lower receiver 10 (i.e., a lug feature of the additional component is coaxial with front pin hole 11) such that pivot pin 101 engages both the lower receiver 10 and the additional component.

The components of any of the pivot pin assembly 100 and/or the lower receiver 10 described herein may be formed of materials including, but not limited to, thermoplastic, carbon composite, plastic, nylon, steel, aluminum, stainless steel, high strength aluminum alloy, titanium, other plastic or polymer materials, other metallic materials, other composite materials, or other similar materials. Moreover, the components may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A pivot pin for a firearm, the pivot pin comprising:
a proximal end;
a distal end;
a cylindrical surface extending between the proximal end and the distal end;
a head disposed at the distal end, the head comprising a flat portion;
a groove extending along at least a portion of a length of the cylindrical surface, the groove comprising a first recess and a second recess; and
a hole extending through the pivot pin, wherein the hole is located between the groove and the proximal end and the hole is designed for a detent to pass through the hole,
wherein at least one selected from the group of the first recess and the second recess comprises a through hole; and
wherein at least part of the through hole is smaller in diameter than the detent.

2. The pivot pin of claim 1, wherein the hole comprises a bevel on at least one selected from the group of a first end and a second end of the hole.

3. The pivot pin of claim 1, wherein an axial direction of the hole is approximately perpendicular to a location of the groove on the cylindrical surface.

4. The pivot pin of claim 1, wherein:
the first recess is disposed at a first end of the groove;
the second recess is disposed at a second end of the groove;
the first end of the groove is disposed closer to the proximal end of the pivot pin; and
the second end of the groove is disposed closer to the distal end of the pivot pin.

5. The pivot pin of claim 1, wherein at least one selected from the group of the first recess and the second recess comprises a blind hole.

6. The pivot pin of claim 1, wherein a size of the hole is configured for the detent and a detent spring to pass through the hole.

7. The pivot pin of claim 6, wherein the detent and the detent spring are configured to pass through the hole and into a detent hole of a receiver when the pivot pin is at least partially inserted into a front pin hole of the receiver.

8. The pivot pin of claim 1, wherein the pivot pin comprises titanium.

9. A pivot pin assembly for installation into a receiver of a firearm, the pivot pin assembly comprising:
a pivot pin;
a detent; and
a detent spring,
wherein the pivot pin comprises:
a proximal end;
a distal end;
a cylindrical surface extending between the proximal end and the distal end;
a groove extending along at least a portion of a length of the cylindrical surface, the groove comprising a first recess and a second recess; and
a hole extending through the pivot pin, wherein the hole is located between the groove and the proximal end,
wherein at least one selected from the group of the first recess and the second recess comprises a through hole; and
wherein at least part of the through hole is smaller in diameter than the detent.

10. The pivot pin assembly of claim 9, wherein the hole comprises a bevel on at least one selected from the group of a first end and a second end of the hole.

11. The pivot pin assembly of claim 9, wherein an axial direction of the hole is approximately perpendicular to a location of the groove on the cylindrical surface.

12. The pivot pin assembly of claim 9, wherein a size of the hole is configured for the detent and the detent spring to pass through the hole.

13. The pivot pin assembly of claim 9, wherein:
the first recess is disposed at a first end of the groove;
the second recess is disposed at a second end of the groove;
the first end of the groove is disposed closer to the proximal end of the pivot pin; and
the second end of the groove is disposed closer to the distal end of the pivot pin.

14. The pivot pin assembly of claim 9, wherein at least one selected from the group of the first recess and the second recess comprises a blind hole.

15. The pivot pin assembly of claim 9, further comprising an open configuration and a closed configuration, wherein:
the detent engages the first recess of the groove when the pivot pin assembly is in the open configuration; and
the detent engages the second recess of the groove when the pivot pin assembly is in the closed configuration.

16. The pivot pin assembly of claim 9, wherein the pivot pin comprises titanium.

17. The pivot pin assembly of claim 9, wherein the detent and the detent spring are configured to pass through the hole and into a detent hole of the receiver when the pivot pin is at least partially inserted into a front pin hole of the receiver.

* * * * *